US005345852A

United States Patent [19]

Takahashi et al.

[11] Patent Number: 5,345,852

[45] Date of Patent: Sep. 13, 1994

[54] DRAINAGE STRUCTURE OF A VOLUTE HORN

[75] Inventors: Hidefumi Takahashi, Sawa; Akio Wakai, Maebashi, both of Japan

[73] Assignee: Mitsuba Electric Manufacturing Co., Ltd., Gunma, Japan

[21] Appl. No.: 925,734

[22] Filed: Aug. 7, 1992

[51] Int. Cl.[5] ..... G10D 7/10

[52] U.S. Cl. ..... 84/397; 116/142 R

[58] Field of Search ..... 84/397; 116/142 FP, 116/142 R, 137 R

[56] References Cited

U.S. PATENT DOCUMENTS 2,482,903 9/1949 De Rubeis ..... 84/397
3,782,236 1/1974 Shalek et al. ..... 84/397

FOREIGN PATENT DOCUMENTS 48-9076 2/1973 Japan .
48-72871 9/1973 Japan .
49-49867 5/1974 Japan .
53-97986 8/1978 Japan .
60-25120 7/1985 Japan .
3-78645 8/1991 Japan .

*Primary Examiner*—Michael L. Gellner
*Assistant Examiner*—Cassandra Spyrou
*Attorney, Agent, or Firm*—Oliff & Berridge

[57] ABSTRACT

A drainage structure of a volute horn including a resonating device has a cover and a base which form a volute sound path. A relatively long and narrow drainage passageway is formed in the portion of the resonating device where water collects for draining water from the sound path such that the sound pressure in the sound path remains constant. As a result, the integrity of the horn sound is maintained.

18 Claims, 4 Drawing Sheets

DRAINAGE STRUCTURE OF A VOLUTE HORN

BACKGROUND OF THE INVENTION

1. Field of the Invention

The present invention relates to a drainage structure of a volute horn, and more specifically to a drainage structure of a volute horn arranged to enable efficient drainage from a sound path while maintaining the integrity of the sound.

2. Description of the Related Art

A volute horn utilizes an electromagnet to vibrate a diaphragm. Sound is produced by the vibration of the diaphragm and is adjusted in a resonating unit which forms a volute path along which the sound travels. The travelling sound is transmitted to the outside as a horn sound. Since the resonating unit has a bugle-like opening, it is impossible to completely prevent water, such as rainwater, from entering the sound path, even if the horn is attached so that the opening faces downward. For this reason, as shown in FIG. 7, water collects in the sound path and thereby changes the quality and loudness of the sound. If enough water exists in the sound path, the horn cannot produce any sound.

To overcome such a disadvantage, a drainage hole is formed in the resonating unit. Such a drainage hole, however, causes a decrease in pressure within the sound path. The quality and loudness of the sound markedly change with such a decrease in pressure. Another disadvantage with such an arrangement is that water may enter the sound path through the drainage hole.

SUMMARY OF THE INVENTION

Accordingly, it is an object of the present invention to provide a volute horn having a drainage structure which overcomes the above-described problems of the prior art.

It is another object of the present invention to provide a volute horn with a drainage structure which enables efficient drainage from a sound path while maintaining the integrity of the sound.

The present invention provides a drainage structure of a volute horn integral with a resonating device forming a volute sound path. The structure includes a relatively long and narrow drainage passageway and two opposing drainage holes. One hole is exposed to the sound path where water generally collects, and the other hole is exposed to a drainage chamber beneath the sound path. A drainage opening is formed in an opposite wall in the drainage chamber to release the water from the drainage chamber. The pressure in the sound path is directly proportional to the diameter of the holes of the drainage passageway and inversely proportional to the length of the drainage passageway. Hence, the structure of the present invention, including a long drainage passageway and opposing small diameter drainage holes, enables efficient drainage while maintaining the pressure in the sound path, thereby preserving the integrity of the sound.

BRIEF DESCRIPTION OF THE DRAWINGS

Other objects and advantages will become apparent when considered in light of the following detailed description of preferred embodiments taken in conjunction with the accompanying drawings wherein.

DESCRIPTION OF PREFERRED EMBODIMENTS

Figure 1:
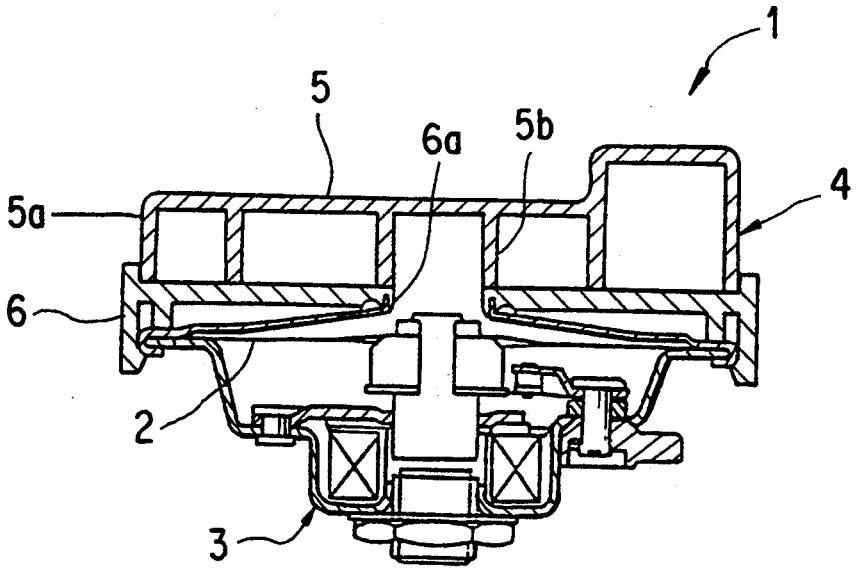
FIG. 1 shows a sectional view of a volute horn of the present invention.

Referring to FIG. 1, a vehicle volute horn 1 is integrally formed with a vibration generating unit 3 and a resonating unit 4, which forms a volute sound path. Sound is produced by the vibration of a diaphragm 2. The sound is adjusted in resonating unit 4, and then transmitted to the outside through an opening 5*c*. Vibration generating unit 3 utilizes an electromagnet (not shown) to vibrate diaphragm 2.

Resonating unit 4 is integrally formed with a cover 5 and a base 6, both joined by joining means such as an adhesive. Cover 5 has a peripheral wall 5*a*, a split wall 5*i* and an inner wall 5*b*, defining the volute sound path. Base 6 covers the sound path in an airtight manner. An opening 6*a*, through which sound produced by diaphragm 2 is transmitted, is formed at the center of base 6 for transmitting sound into the innermost end of the volute sound path. Opening 5*c*, for transmitting the horn sound to the outside, is formed at the bottom of cover 5.

Figure 2:
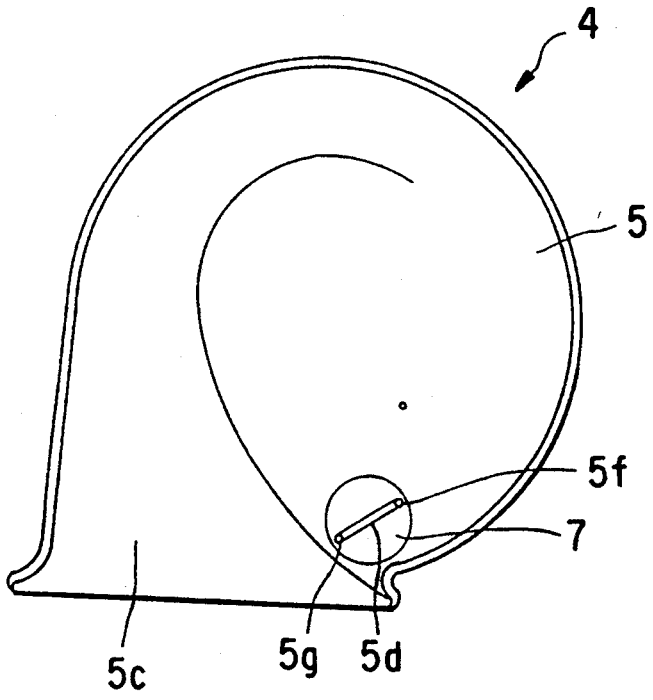
FIG. 2 is a front view of a resonating unit.
Figure 3:
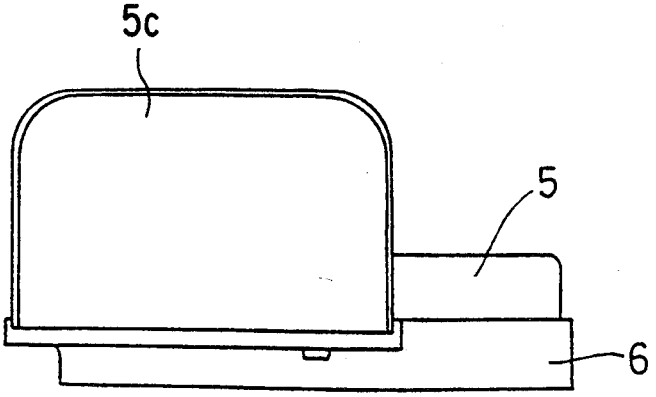
FIG. 3 is a bottom view of the resonating unit.
Figure 4:
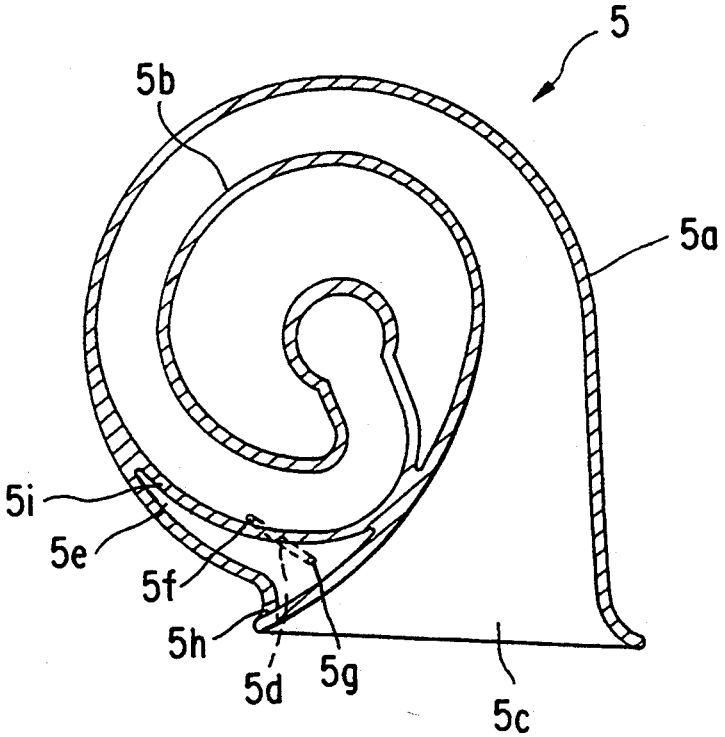
FIG. 4 is a longitudinal sectional view of the resonating unit.
Figure 5:
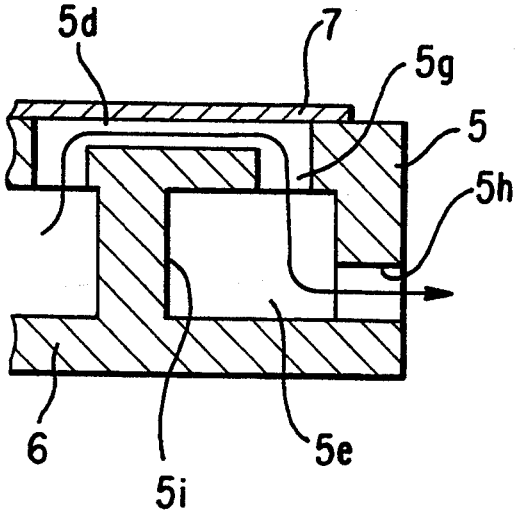
FIG. 5 is an enlarged sectional view taken from above the drainage passageway and through groove 5*d* in FIG. 4 of the main components of the drainage structure.

Referring to FIGS. 2, 4 and 5, a drainage groove 5*d* is formed at the front lower end of cover 5 and is oriented in a downward angle. One end of drainage groove 5*d* communicates through a drainage hole 5*f* with the portion of the sound path where water collects. The other end of drainage groove 5*d* communicates through another drainage hole 5*g* with a cone-shaped drainage chamber 5*e*, which is a chamber positioned below the water collecting portion and formed of peripheral wall 5*a* and split wall 5*i*. Each of the drainage holes 5*f* and 5*g* has a small diameter in the range of 1.0 to 2.0 mm, and preferably about 1.5 mm. Drainage groove 5*d* is covered with a film seal 7 and thereby forms a long and slender labyrinthine drainage passageway having a length in the range of 8 to 20 mm and preferably about 13 mm. Hence, the ratio of the length to the diameter of the passageway is in the range of 4 to 20 and preferably about 8.667. Water accumulated in the water collecting portion is first discharged to drainage chamber 5*e* through drainage groove 5*d*, and then to the outside through a drainage opening 5*h* formed in peripheral wall 5*a*.

With the above-defined structure, the water accumulated in the water collecting portion of the sound path is discharged to the outside through drainage hole 5*f*, drainage groove 5*d*, drainage hole 5*g*, drainage chamber 5*e* and then drainage opening 5*h*. The small diameter of drainage hole 5*f* and the length and slenderness of drainage groove 5*d* prevent pressure from decreasing within the sound path. A decrease in pressure within the sound path is directly proportional to the diameter of the drainage holes and inversely proportional to the length of the passageway. Thus, the higher the ratio of the length to the diameter of the drainage passageway, the better the ability to inhibit a decrease in pressure in the sound path. Water is discharged through the relatively long and narrow drainage passageway, and pressure is therefore prevented from decreasing. As a result, the integrity of the sound is maintained, and a consistent, high quality horn sound is always produced. Moreover, because of the long, narrow labyrinthine drainage passageway, water can be reliably prevented from entering the sound path through the drainage passageway.

Figure 6:
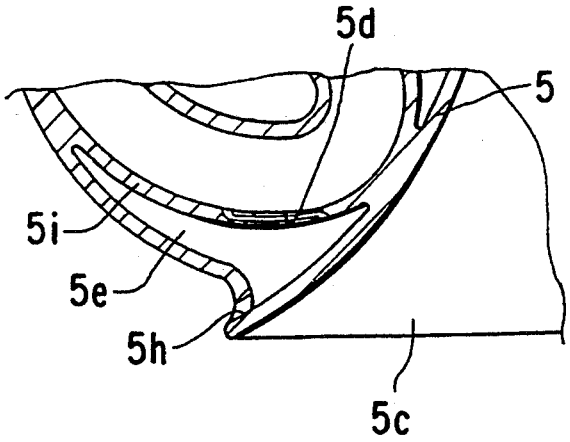
FIG. 6 is a sectional view of another embodiment of the present invention.
Figure 7:
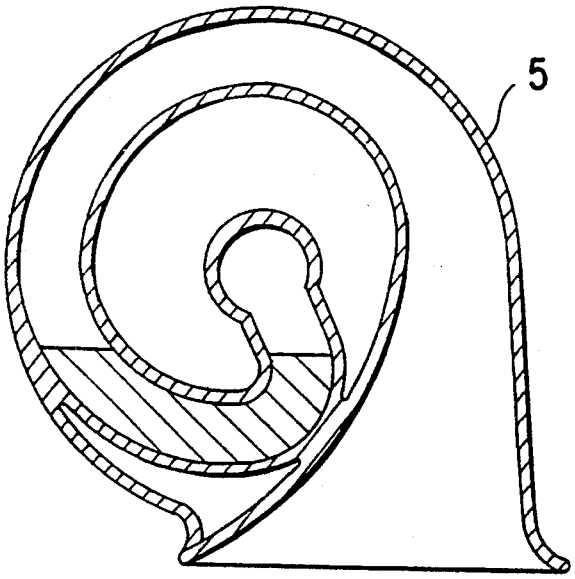
FIG. 7 PRIOR ART
FIG. 7 shows the resonating unit of a conventional horn.

The present invention is not limited to the above-described embodiment. Another embodiment of the present invention is shown in FIG. 6. Drainage groove 5*d* is formed at the end surface of split wall 5*i*. The drainage passageway is formed so as not to run through drainage chamber 5*e*.

As described above, the present invention provides a drainage passageway for discharging water, such as rainwater, collected in a resonating unit. The resonating unit forms a volute sound path. Since the drainage passageway is relatively long and has a small diameter, it is capable of inhibiting a decrease in sound pressure in the sound path. The pressure is directly proportional to the diameter of the drainage passageway and inversely proportional to the length of the drainage passageway. Thus, with a high length to diameter ratio, water can be reliably discharged without changing the quality and loudness of sound. As a result, a uniform, high quality horn sound is always produced. In addition, because of the long, narrow drainage passageway, water can be prevented from entering the sound path through the drainage passageway.

Although the present invention has been described in detail, it will be apparent to those skilled in the art that various modifications may be made without departing from the scope of the invention, which is defined in the following claims.

We claim:

1. A volute horn comprising a resonating device having a volute sound path with a water collecting portion therein and a drainage structure communicating with said volute sound path at said water collecting portion, said drainage structure comprising a continuously open labyrinthine drainage passageway having a length and a diameter with a large length to diameter ratio in the range of 4 to 20, said passageway inhibiting a decrease in sound pressure in the volute sound path while enabling drainage of water during operation of said resonating device.

2. A volute horn according to claim 1, wherein said resonating device comprises a cover coupled to a base, said cover including a volute peripheral wall, a volute inner wall spaced from said peripheral wall, and split wall extending from said peripheral wall to said inner wall, wherein said peripheral wall, said inner wall and said split wall define said volute sound path.

3. A volute horn according to claim 2, wherein said drainage passageway is located in said cover.

4. A volute horn according to claim 2, wherein said drainage passageway is formed in said split wall.

5. A volute horn according to claim 2, wherein said drainage passageway comprises a groove formed in said cover and a sealing member covering said groove.

6. A volute horn according to claim 2, wherein said drainage passageway comprises a groove formed in an end surface of said split wall sealed by said base.

7. A volute horn according to claim 2, wherein a portion of said peripheral wall, a portion of said inner wall and said split wall define a drainage chamber separated from said volute sound path by said split wall and communicating with said volute sound path by said drainage passageway.

8. A volute horn according to claim 7, wherein said drainage passageway is formed in said cover.

9. A volute horn according to claim 7, wherein said drainage chamber has a discharge opening in said portion of said peripheral wall.

10. A volute horn according to claim 7, wherein said resonating device has a flared opening for transmitting sound from said volute sound path to outside and said drainage chamber is disposed adjacent to said opening.

11. A volute horn according to claim 1, wherein said ratio is about 8.667.

12. A volute horn according to claim 1, wherein said length is about 13 mm and said diameter is about 1.5 mm.

13. A volute horn according to claim 1, wherein said drainage passageway has an entry opening in said volute sound path and an exit opening, wherein said entry opening and said exit opening are not linearly aligned.

14. A horn having a resonating unit forming a sound path and a drainage structure communicating with said sound path, said drainage structure consisting of a continuously open non-linear, long, narrow drainage passageway, wherein said drainage structure releases water from said sound path while allowing pressure to be maintained in said sound path during operation of said resonating unit.

15. A horn according to claim 14, wherein said passageway has a length and a diameter and the length to diameter ratio is in the range of 4 to 20.

16. A horn according to claim 15, wherein said ratio is about 8.667.

17. A horn according to claim 14, wherein said sound path is volute.

18. A horn according to claim 14, wherein said resonating unit includes a drainage chamber in communication with said sound path via said drainage passageway.

* * * * *